United States Patent [19]

Yang

[11] Patent Number: 4,793,533

[45] Date of Patent: Dec. 27, 1988

[54] INTIMACY-PROMOTING BABY FEED BOTTLE

[76] Inventor: Tai-Her Yang, 5-1 Taipin St., Si-Hu Town, Dzan-Hwa, Taiwan, Taiwan

[21] Appl. No.: 93,138

[22] Filed: Sep. 3, 1987

Related U.S. Application Data

[63] Continuation of Ser. No. 817,249, Jan. 8, 1986, abandoned.

[51] Int. Cl.[4] ..... A45F 65/00

[52] U.S. Cl. ..... 224/148; 215/11.1

[58] Field of Search ..... 224/148; 215/11 R; 248/102; 128/77, 79

[56] References Cited

U.S. PATENT DOCUMENTS

| | | | |
|---|---|---|---|
| 78,881 | 6/1868 | Libbey . | |
| 371,005 | 10/1887 | Vessel | 215/11.1 |
| 1,723,731 | 8/1929 | Hafling | 215/11 R |
| 2,500,846 | 4/1946 | McFarland | 224/148 |
| 2,939,598 | 6/1960 | Donleavy | 215/11 R |
| 3,071,272 | 1/1963 | Dower | 215/11 R |
| 4,140,254 | 2/1979 | Land | 224/148 |
| 4,570,808 | 2/1986 | Campbell et al. | 215/11.1 |
| 4,676,387 | 6/1987 | Stephenson et al. | 215/11.1 |

*Primary Examiner*—Henry J. Recla

*Attorney, Agent, or Firm*—Leonard Bloom

[57] ABSTRACT

A baby feed bottle designed to be mounted in close contact with the user's chest and on which there is provide indicia to reference the amount of feeding fluid therein.

7 Claims, 2 Drawing Sheets

INTIMACY-PROMOTING BABY FEED BOTTLE

This application is a continuation of application Ser. No. 817,249, filed Jan. 8, 1986, now abandoned.

BACKGROUND OF THE INVENTION

This design mainly provides a baby feed bottle that can be hung on the baby feeder's back or chest to make the baby and the feeder obtain a more natural baby feeding state, thereby promoting the intimacy between them.

SUMMARY OF THE INVENTION

This invention provides a structural design of the baby feed bottle, its main features is that the bottle itself is in a flat and thin arcuate farm and a convex arcuate surface is provided under its front perimeter surface and is also profided with a bottle mouth to receive the bottle lid and nipple, two sets of hook body are provided on the two sides of the bottle body respectively, and a hang band can go through and set in one of the said two sets of hook body, while two elastic bundleing bands can go through and set in the other set of hook body to make the milk feeder use the suspension or tieing to way to position the bottle before his (her) chest and his (her) two hands can to hold the baby to such the milk, thereby maximizing the intimacy between the feeder and the baby.

DETAILED DESCRIPTION OF THE INVENTION

As to the conventional baby feed bottles, during feeding a baby, the feeder has to hold the baby with one of his (her) hands, while his (her) other hand grasps the bottle to do it, unlike the usual practice of the mother chest feeding by holding her baby with her two hands to feed the baby and to touch and cheer her at the same time, thereby achieving a deep intimacy betwen them, to feed a baby with a bottle as such would adversely affect the improvement on intimacy between the parent and her (his) baby.

The structure of the intimacy-promoting baby feed bottle in this invention is to improve the defects of the conventional feed bottles in this respect, and its main features lie in that the feeder can proceed the feeding process by firmly hanging or tieing this invention on her (his) chest, and at the same time, the baby can embrace the feeder in a natural way, while the feeder may also hold the baby with her (his) hands and touch and cheer the baby, thereby achieving the effects as of the mother chest feeding.

Figure 1:
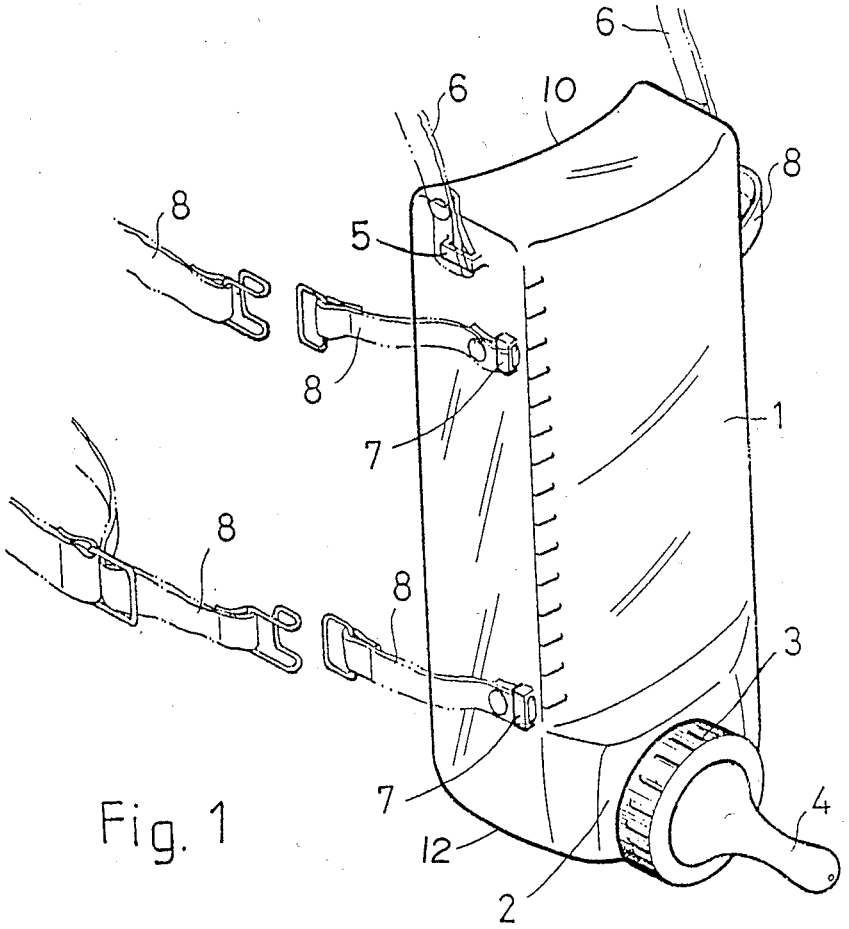
FIG. 1 is a structural a three-dimensional view of the invention.
Figure 2:
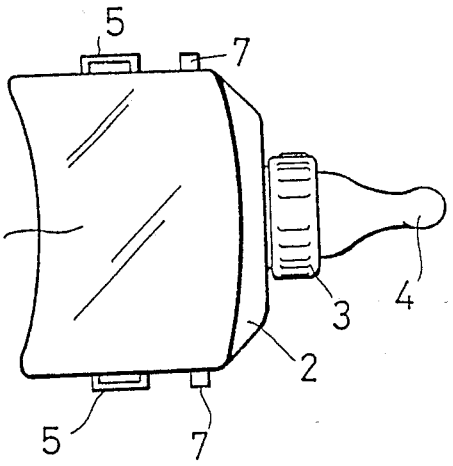
FIG. 2 is a top view of the invention

Now, the structure of the invention is detailed as follows according to the examplary embodiments in the accompanying drawings:

As shown in FIG. 1, the baby feed bottle body having a front wall 1 in the invention is in a thin and flat arcuate form (an elongated, arcuate shape) and its bottom face is in a slope design, a convex arcuate surface (lower feeding portion) 2 is provided under its front edge surface, a bottle mouth (feed aperture) is provided in the central part of the arcuate surface 2 to join a bottle lid 3 and also for positioning the nipple (feed nipple) 4, a graduated scale is provided at the front edge surface or the proper edge surface of the bottle body 1 to provide the indication reference of the amount of the milk (infant feed formula) to be prepared.

Ahook body (upper hook member) 5 is provided at the angular part of the edge (upper edge) of the two side surfaces (sidewalls) of the bottle body 1 that close to the top respectively for respective end of a hang band (neck strap band) 6 to go through and remain therein, a set of hook bodies (lower hook members) 7 in a spaced intervals between them is provided at the corner part of the edge of the two side surfaces that closes to the front edge surface respectively, a set of a respective end of elastic tie bands 8 goes through and join one of the two sets of hook bodies 7 each of the said hang bands 6 and tie bands 8 has a length-adjustable function to make proper adjustments according to the actual needs of the feeder so as to firmly hand or tie the bottle body at a proper position on his (her) chest to facilitate the feeding work like the chest feeding way.

The feed bottle body 1 in this invention is in a flat and thin arcuate design (arcuate plane) and its back rim surface 10 is in a concave form to make the feeder's body have a better contact ability comparatively uneasy to make displacements and also have a sense of comfortability. Besides, since the bottle body 1 closely contacts the feeder's body, the human body temperature can maintain the milk in the bottle warm without being cooled off rapidly and thus, avoid the defects caused by the baby's longer sucking time to make the milk lost its temperature which in turn leads the baby's diarrhea or dislikes of sucking milk.

Figure 3:
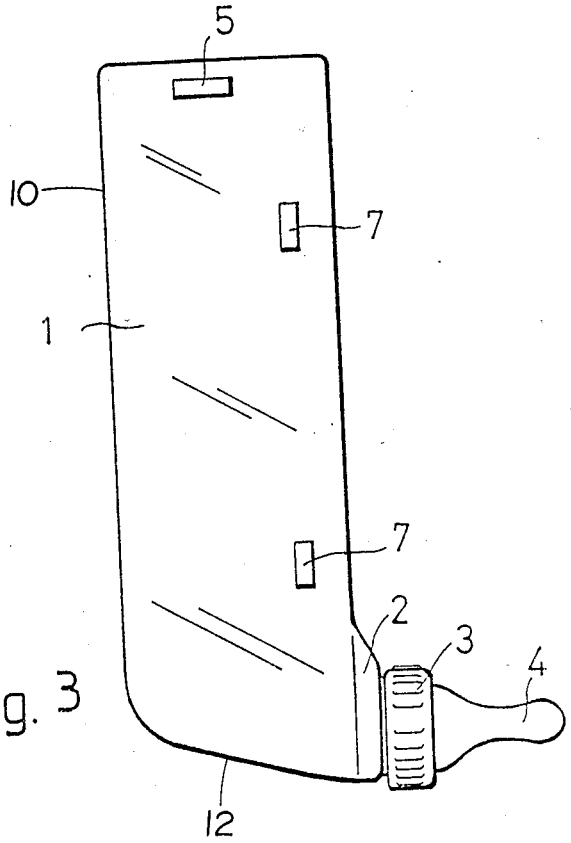
FIG. 3 is a side view of the invention

As shown in FIG. 3, the bottom 12 of the feed bottle body 1 in this invention is in a slope form to make the nipple to positioned at the lowest place, the action is to make the milk in the bottle body 1 smoothly supplied to the position of the nipple 4 to the last drop without any wastes.

As to this design in the practical examplary embodiment, in addition to its above-said forms, the feed bottle also be forms such as an approximate flat and thin square, sphere, polygon, or any other geometric shape for the users' choice and also to maximize its applicability, its hang band and or tie band can be selectively used one at a time or in combination according to the needs or even several of such bands maybe provided thereon, the feed bottle itself can be further made of a flexible material that can be deformed under pressure to increase the pressure applied by the baby during the feeding process according to the baby's own adjustments on the baby's mouth and the feeder's chest thereby changing the feeding volume in the same effects as of the natural mother's chest feeding.

Summing all the above up, the intimacy-promoting baby feed bottle in this invention is to provided a bottle feeder with a means in a mother's chest feed way, and its construction is simplified and easy and convenient to use and has a number of practical advantages, so this is an innovative utility invention.

What is claimed is:

1. An infant feeding bottle comprised of:

an elongated, arcuately-shaped body including a front wall having an arcuate plane, a concavely-formed rear wall, a bottom wall, and a pair of sidewalls; wherein the body is adapted to be held substantially vertically during feeding, and wherein the concavely-formed rear wall is adapted to fit the bottle on the mother or other person during feeding and to promote an intimacy with the baby, said front wall having a lower substantially arcuately-shaped feeding portion extending outwardly from the bottom of the arcuate plane of the front wall, said feeding portion having a feed aperture formed therein;

a flexible feed nipple secured to the lower feeding portion over the feed aperture, providing for the controlled flow of feed formula therethrough, from the bottle, in response to the suckling of an infant;

the bottom wall being inclined downwardly from the rear wall to the front wall to facilitate a smoother flow of fluid out of the nipple, and means for supporting the body on a mother of other person comprising a neck strap secured to respective first hooks on the side walls of the body, and further comprises at least one body strap secured to respective second hooks on the side walls.

2. The infant feeding bottle of claim 1, wherein the neck strap band is adjustable, and further wherein the body strap band is adjustable and further wherein each end of the neck strap band and the body strap band is removably secured within a respective hook member.

3. An infant feeding bottle to promote intimacy between the feeder and an infant, comprised of:

an elongated, arcuately-shaped body for receiving an infant feed formula therein, said body including a front wall having an arcuate plane, a concavely-formed rear wall, a bottom wall, and a pair of sidewalls, said front wall having a lower, substantially arcuately-shaped feeding portion extending outwardly from the arcuate plane of the front wall, said feeding portion having a feed aperture formed therein; wherein the body is adapted to be held substantially vertically during feeding, and wherein the concavely-formed rear wall is adapted to fit comfortably on the mother or other person during feeding and to promote an intimacy with the baby;

said sidewalls each having an upper edge and each further having a front edge being substantially contiguous with the front wall;

a flexible feed nipple secured to the lower feeding portion over the feed aperture and extending outwardly therefrom, said nipple being positioned extending radially from the arcuate plane of the front wall, thereby providing for the controlled flow of the infant feed formula from the bottle in response to the suckling action of an infant;

the bottom wall being inclined downwardly from the rear wall to the front wall to facilitate a smoother flow of fluid out of the bottle;

a pair of upper hook members being positioned on a respective sidewall substantially adjacent the upper edge thereof;

two pairs of lower hook members being positioned on each of the respective sidewalls substantially adjacent to the front edge thereof, the hook members of each respective pair being spaced from one another;

an adjustable neck strap band having two ends, each end being received through, and removably secured within, a respective upper hook member; and an adjustable body strap band having four ends, each respective end being received through, and removably secured in, a respective lower hook member, wherein when the strap bands are secured to the respective hook members and worn by the user, said strap bands may be used to support the bottle on the feeder's chest.

4. A baby bottle adapted to facilitate a smooth flow of milk or other fluids to a baby, while promoting an intimacy between the baby and its mother or other person during feeding, comprising a relatively-flat body including a front wall having a lowermost portion, a rear wall, respective side walls and a bottom wall, the body being held in a substantially vertical position during feeding, the rear wall of the body being concavely formed and being adapted to fit comfortably on the body of the mother or other person during feeding, thereby preventing rapid cooling of the milk in the bottle by means of the body temperature of mother or other person doing the feeding, a nipple carried by the lowermost portion of the front wall and extending forwardly therefrom substantially at right angles thereto, the bottom wall being inclined downwardly from the rear wall to the front wall, thereby facilitating a smoother flow during feeding, and means for supporting the body on the mother or other person during feeding, and means for supporting the body on a mother or other person comprising a neck strap secured to respective first hooks on the side walls of the body, and further comprises at least one body strap secured to respective second hooks on the side walls.

5. The baby feed bottle of claim 4, wherein a pair of spaced-apart body straps is provided, and wherein the body straps and the neck strap are adjustable.

6. A baby bottle adapted to facilitate a smooth flow of milk or other fluids to a baby, while promoting an intimacy between the baby and its mother or other person during feeding, comprising a relatively-flat body including a front wall having a lowermost portion, a rear wall, respective side walls and a bottom wall, the body being held in a substantially vertical position during feeding, a nipple attached to the lowermost portion of the front wall and extending forwardly therefrom substantially at right angles thereto, the bottom wall being inclined downwardly from the rear wall to the front wall, thereby facilitating a smoother flow during feeding, and means for supporting the body on the mother or other person during feeding, said last-named means comprising a neck strap secured to respective first hooks on the side walls of the body, and further comprising at least one body strap secured to respective second hooks on the side walls.

7. A baby bottle adapted to facilitate a smooth flow of milk or other fluids to a baby, while promoting an intimacy between the baby and its mother or other person during feeding, comprising a relatively-flat body including a front wall having a lowermost portion, a rear wall, respective side walls and a bottom wall, the body being held in a substantially vertical position during feeding, thereby facilitating a smoother flow during feeding, the rear wall of the body being concavely formed and being adapted to fit comfortably on the body of the mother or other person during feeding, a nipple carried by the lowermost portion of the front wall and extending forwardly therefrom substantially at right angles thereto, and means for supporting the body on the mother or other person during feeding, said last-named means comprising a neck strap secured to respective first hooks on the side walls of the body, and further comprising a pair of spaced-apart body straps secured to respective second hooks on the side wall, wherein the body straps and the neck strap are adjustable.

* * * * *